US006896055B2

(12) United States Patent
Koithan

(10) Patent No.: US 6,896,055 B2
(45) Date of Patent: May 24, 2005

(54) METHOD AND APPARATUS FOR CONTROLLING WELLBORE EQUIPMENT

(75) Inventor: Thomas Koithan, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 129 days.

(21) Appl. No.: 10/360,547

(22) Filed: Feb. 6, 2003

(65) Prior Publication Data

US 2004/0154832 A1 Aug. 12, 2004

(51) Int. Cl.[7] ..... E21B 47/00
(52) U.S. Cl. ..... 166/250.15; 166/53
(58) Field of Search ..... 166/250.01, 250.15, 166/53; 175/24, 40, 45

(56) References Cited

U.S. PATENT DOCUMENTS

| | | | | | |
|---|---|---|---|---|---|
| RE34,063 | E | | 9/1992 | Vincent et al. | 73/862.23 |
| 5,721,538 | A | | 2/1998 | Tubel et al. | |
| 5,868,201 | A | * | 2/1999 | Bussear et al. | 166/53 |
| 5,955,666 | A | * | 9/1999 | Mullins | 73/152.18 |
| 6,405,135 | B1 | * | 6/2002 | Adriany et al. | 702/5 |
| 6,491,828 | B1 | * | 12/2002 | Sivavec et al. | 210/739 |
| 6,531,694 | B2 | * | 3/2003 | Tubel et al. | 250/227.14 |
| 6,766,854 | B2 | * | 7/2004 | Ciglenec et al. | 166/250.11 |
| 2002/0121012 | A1 | | 9/2002 | Murakami et al. | |
| 2002/0195247 | A1 | * | 12/2002 | Ciglenec et al. | 166/250.11 |
| 2003/0094281 | A1 | * | 5/2003 | Tubel | 166/250.03 |
| 2004/0065439 | A1 | * | 4/2004 | Tubel et al. | 166/250.15 |

FOREIGN PATENT DOCUMENTS

| | | |
|---|---|---|
| GB | 2 247 904 | 3/1992 |
| WO | WO 02/25319 | 3/2002 |

OTHER PUBLICATIONS

EP Search Report, Application No. 04250651.9–2315, dated May 25, 2004.

* cited by examiner

*Primary Examiner*—William Neuder
(74) *Attorney, Agent, or Firm*—Moser, Patterson & Sheridan, L.L.P.

(57) ABSTRACT

The present invention generally provides a method for remotely controlling and/or monitoring at least one parameter of well bore equipment. In one aspect, the invention includes a method comprising the steps collecting data corresponding to the parameter with a sensor module; transmitting the collected data to an on-site universal data acquisition and control system; transmitting the data from the universal data acquisition and control system to a remote control/monitoring unit via a communication link; and transmitting control data from the control/monitoring unit back to at least the universal data acquisition and control system for modifying the operation of the well operation equipment.

31 Claims, 2 Drawing Sheets

METHOD AND APPARATUS FOR CONTROLLING WELLBORE EQUIPMENT

BACKGROUND OF THE INVENTION

1. Field of the Invention

This invention relates to a method and an apparatus for remotely controlling and/or monitoring well bore equipment arranged at oil or gas wells, and relate more particularly but not exclusively to a method for remotely controlling and/or monitoring at least one parameter of preferably mechanized well bore equipment arranged at oil or gas wells and to a rig control and monitoring system.

2. Description of the Related Art

An oil or gas well includes a well bore extending from the surface of the earth to some depth therebelow. For completion and operation of different wells, different equipment is sometimes necessary within the well bore and at the surface of the well. Such equipment is used for drill pipe handling, pressure control, tubing work, casing handling, and well installation. Traditionally, such equipment has been manually operated. Currently, the industry trend is toward mechanization and automation of such equipment where possible.

For example, mechanized rig systems improve rig flow operations by helping operators install tubing, casing, and control pipe more safely and efficiently during demanding drilling operations. Such a mechanized rig system reduces the time needed for pipe handling, make-up and break out of pipe connections.

Other mechanized equipment for well bores provides efficient means of automatic tubular handling and running. Other mechanized well bore equipment includes tongs, like tubing tongs, basing tongs, fiberglass pipe tongs, and drill pipe tongs for making up tubular connections. There are also tongs used in systems for placing a predetermined torque on a connection as well as tongs having independent rotation devices disposed therein. Additionally, some tongs include maneuvering devices that may be rail mounted are designed to suspend casing, tubing or drill type tongs from a frame.

In addition to the foregoing description, devices are routinely further automated and mechanized through the use of sensors for controlling and monitoring equipment and also for monitoring parameters of such equipment, like temperature, pressure, fluid flow, and torque, for example.

According to known methods for controlling and/or monitoring such a parameter, a corresponding sensor is generally connected to a measuring device which is part of or at least directly connected to some kind of computer terminal. The data from the sensor is transmitted to such measuring device and from this to the computer terminal. The measuring device comprises for example, a micro controller with customized software that may be used for collecting the data from the sensor and to transmitting it to the computer terminal. At the computer terminal, the data is processed and then displayed as a graphical display, like a bar graph, for example.

As computer terminals and measuring devices are arranged quite close to the corresponding sensor, the personnel operating the computer terminal are also necessarily working quite close to the sensor, and therefore, to the well bore or corresponding equipment of the well. Dangerous conditions arise because of possible contact with the different mechanized equipment. It is also an atmosphere that makes it difficult for personnel to work with high concentration because of exposure of the personnel to weather, noise, etc. present at the well.

Moreover, there are strict requirements for the use of such devices near a well bore, as they typically have to be integrated within a sealed enclosure, or "explosion proof," or they have to be purged with cooled, circulating air to keep the electronic components cool for more reliable operation.

Furthermore, the corresponding computer terminal used for evaluating the data collected from the sensors is typically some distance from the mechanized well bore equipment or the other equipment of the well whose parameters are monitored. Consequently, the result of the evaluation of the data is not directly useable for controlling and adjusting the equipment, and a separate communication channel is necessary, like a phone call or even by voices raised above the level of background noise.

Thus, it may take some time to control or adjust the equipment in reaction of the evaluation of the collected data, which may cause an interruption in well operations.

It is therefore an object of the invention to improve the corresponding method and also rig control and monitoring system such that it is possible to remove personnel from the equipment at the well to improve safety and also to render possible fast responses or reactions of the equipment based on the evaluation of the collected data without interruption of the working process.

SUMMARY OF THE INVENTION

The present invention generally, in one aspect is a method for remotely controlling and/or monitoring at least one parameter of well bore equipment comprising the steps of:

- collecting data corresponding to the parameter with a sensor module assigned to the corresponding well bore equipment;
- transmitting the collected data to an on-site universal data acquisition and control system for operating the mechanized well bore equipment;
- transmitting the data from the universal data acquisition and control system to a remote control/monitoring unit via a communication link;
- displaying and/or storing the analyzed data at least by the control/monitoring unit, and
- transmitting control data from the control/monitoring unit back to at least the universal data acquisition and control system for modifying the operation of the mechanized well bore equipment in case the parameter has to be adjusted to be within predefined limits.

In another aspect, the analyzed data is displayed and/or stored prior to the control data being transmitted.

According to the invention, a corresponding rig control and monitoring system comprises a piece of mechanized well bore equipment, a sensor module assigned thereto, an on-site universal data acquisition and control system, and a remote control/monitoring unit connected with the universal data acquisition and control system by a communication link, wherein said control/monitoring unit includes a display means and/or a storage means and said universal data acquisition control system is connected with the sensor module for data transmission. In this specification, the term "well bore equipment" means any piece of equipment at near or in a well.

The corresponding sensor module of this invention is not directly connected to the computer terminal or corresponding control/monitoring unit. Consequently, this terminal unit can be arranged at any place relative to the corresponding sensor module, which means the unit may be arranged onshore and used for example for offshore wells. Also, the corresponding personnel can be located remotely from the well and all the equipment such that safety is increased. Additionally, work for the personnel is simplified as there is no longer a need to work in a noisy environment with exposure to the weather elements. Also, it is also no longer necessary to meet the strict requirements for devices arranged quite near to the well, as fireproof, intrinsically safe, explosion proof, etc.

Another advantage of the invention is that the universal data acquisition control system may be connected to a plurality of sensor modules for collecting corresponding data. From this universal data acquisition control system, the data is then transmitted to a control/monitoring unit. Consequently, there is no particular measuring device assigned to the unit or computer terminal, but there is a general and universal data acquisition and control system used for collecting data from the corresponding sensor modules.

The applicant preferably uses a particular operating platform called HiPer™ control system for operating mechanized rig and well bore equipment. This control system of the applicant may be used as the universal data acquisition and control system. In particular, this applicant's control system is already adapted for controlling and adjusting the operation of the corresponding equipment such that by the communication link to the control/monitoring unit, an immediate reaction and modifying or adjusting of the operation of the equipment is possible to maintain a corresponding parameter within defined limits.

It should be noted that such a modifying or adjusting of the operation is also an interruption of the operation in case it is not possible that the equipment may be controlled to keep the parameter within the predefined limits.

To store all the collected data, the corresponding control/monitoring unit may have a storage means. However, to transmit corresponding data in a correct timely sequence to the control/monitoring unit and also to store the data independently from the unit, collected data may be stored in a memory storage means of the universal data acquisition and control system.

In case a sensor module is arranged far away from the universal data acquisition and control system or in case it is difficult to connect sensor module and the system by some kind of hard wired connection, the data from the sensor module is advantageously transmitted to the universal data acquisition control system via a wireless transmission.

In other cases, it may be advantageous to use a wire transmission for example, when there would be a number of interferences in view of a wireless transmission caused by other wireless transmissions used at the well.

Also, for the communication link between the universal data acquisition control system and the control/monitoring unit, a number of realizations are possible.

One possibility is a bus transmission means with corresponding interfaces provided at the control system and at the unit. Examples for such bus transmission means are Ethernet, field bus, RS232, RS485, etc. A corresponding field bus may be for example a profibus, interbus, CAN bus, etc. In particular, if the communication link is realized by Ethernet, such a connection may be a TCP/IP connection.

It is also possible to use a fiber optic transmission means. In the North Sea, for example, a corresponding fiber optic backbone can be used as such a fiber optic transmission means. A further possibility is a wireless transmission means as for example a radio transmission link which may also be realized by a satellite communication link.

A common characteristic of such transmission means or communication links should be that they are high data rate communication links. Of course, also the communication link to a sensor module from the universal data acquisition and control unit may be such a high data rate communication link.

According to the invention, it is possible to collect data from sensor modules from multiple locations and to transmit the data to the universal data acquisition and control system. The different sensor modules at the multiple locations may be the same sensor modules used for example, for measuring pressure. Of course, it is also possible that at each of the multiple locations different sensor modules are arranged or that more than one sensor module is arranged at each of the locations.

For the transmission of the data any known type of modulation of the data may be used, as frequency modulation, amplitude modulation, etc. Moreover, it is advantageous when said communication links are fully duplexed such that data may be easily transmitted in both directions not only between sensor module and data acquisition and control system, but also between control/monitoring unit and data acquisition and control system.

A corresponding sensor module is assigned to any kind of equipment used at a gas or oil well like tubing or casing tongs, drill pipe tongs, remotely operated tongs, tong positioning systems, make-up and break out tools, systems for automatic tubular handling and running, connection leak detection systems, slips, spiders, pressure control equipment, packers, etc. Moreover, corresponding sensor modules may also be assigned to mechanized components as Weatherford's Power Frame™, which is an automatic tubular handling and running, remotely controlled hydraulic rail-mounted system. Another Weatherford control system may also be such a mechanized component as the Torq Winder™, which makes-up and breaks out drill pipe, drill collars, drill bits, stabilizers and bottom hole assemblies.

The parameter monitored by the corresponding sensor module may be for example, torque, number of turns, elapsed time, pressure, temperature, flow, etc. The sensor module may also be adapted to detect a leak of the tubing or casing or any other part of the equipment.

It is of course possible that data from a plurality of sensor modules is displayed and/or stored by the control/monitoring unit wherein the data may be displayed on one screen in different windows or in different pull-down windows or may also be displayed on different screens that have to be selected. Moreover, it is possible to link the data from different sensor modules to obtain a more generalized overview of the corresponding equipment or of all equipment. All other data processing is also possible, as averaging, providing a history of the equipment etc.

In some cases it may also be advantageous if the universal data acquisition and control system provides an on-site access to the collected data or the received control data. By this on-site access, it is possible to check the data directly at the universal data acquisition and control system or to change the received control data to influence the adjustment or modification of the operation of the equipment that would otherwise be initialized by these control data received from the control/monitoring unit.

One example for a system used for data collection by a corresponding sensor module or modules is a torque—turn and torque—time monitoring means and in particular a Weatherford joint analyzed make-up (JAM) system monitoring torque, turns, elapsed time and numbers of rotation of a tong. By such a joint analyzed make-up system, it should be insured that all tubing and casing connections conform to the most exacting manufacturers' specifications. The joint analyzed make-up system can visualize the slightest damage to threaded connections to avoid make-up problems. The corresponding control/monitoring unit may be a computer with a display for such a system wherein different graphs of torque/time and torque/turns may be displayed. For such a JAM system—but not only for this—it is an advantage of the invention that corresponding sensor modules of this system at different locations be served by only one control/monitoring unit realized by a corresponding computer as for example a laptop. The specific data collected from these sensor modules from one location can be shared with the others in order to provide a complete make-up history at the well center. This enables the pre-assembly of pipe in stands at a mouse hole position and forwarding this stand to well center and also forwarding the corresponding JAM data as well to well center in order to track Tally numbering or Tally length control, wherein string length control is important for setting a packer.

The good or bad make-up is immediately notified and forwarded to the rig control system via the corresponding communication link such that no shouting, no phone calls are necessary as with a separate JAM-equipment not using universal data acquisition and control system and corresponding communication links between same and the sensor module and the control/monitoring unit.

For example, this rig control system may be a separate control system different from the universal data acquisition and control system but also be used for receiving the control data from the control/monitoring unit. It is also possible that this rig control system is used as a separate universal data acquisition and control system. The rig control system is normally used to improve the rig operations for installing tubing, casing, drill tools, and string make-up. Such rig control system allows the running of tubulars without exposing personnel in the derrick to dangerous conditions.

It is of course possible to connect at least one more control/monitoring unit to the universal data acquisition and control system wherein this additional unit may be used as a back-up unit or to display the corresponding data to personnel at a different location. A further advantage of the invention is that the universal data acquisition and control system or the separate control system may be integrated into on-site, i.e. rig's individual control means.

Obviously, by such an integration, the universal data acquisition and control system or the separate control system is arranged on a corresponding offshore rig.

As there may be a number of sensor modules for different parameters, it is desirable when said control/monitoring unit comprises at least one evaluation module, to evaluate the received data and display it as a graph, a table, or some other illustration. Independent of the sensor module or the corresponding parameter, another evaluation module may be loaded into the control/monitoring unit wherein such evaluation module may be realized by software on a memory means readable by the unit. It is also possible that a corresponding evaluation module is usable for more than one software module and also for different parameters.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
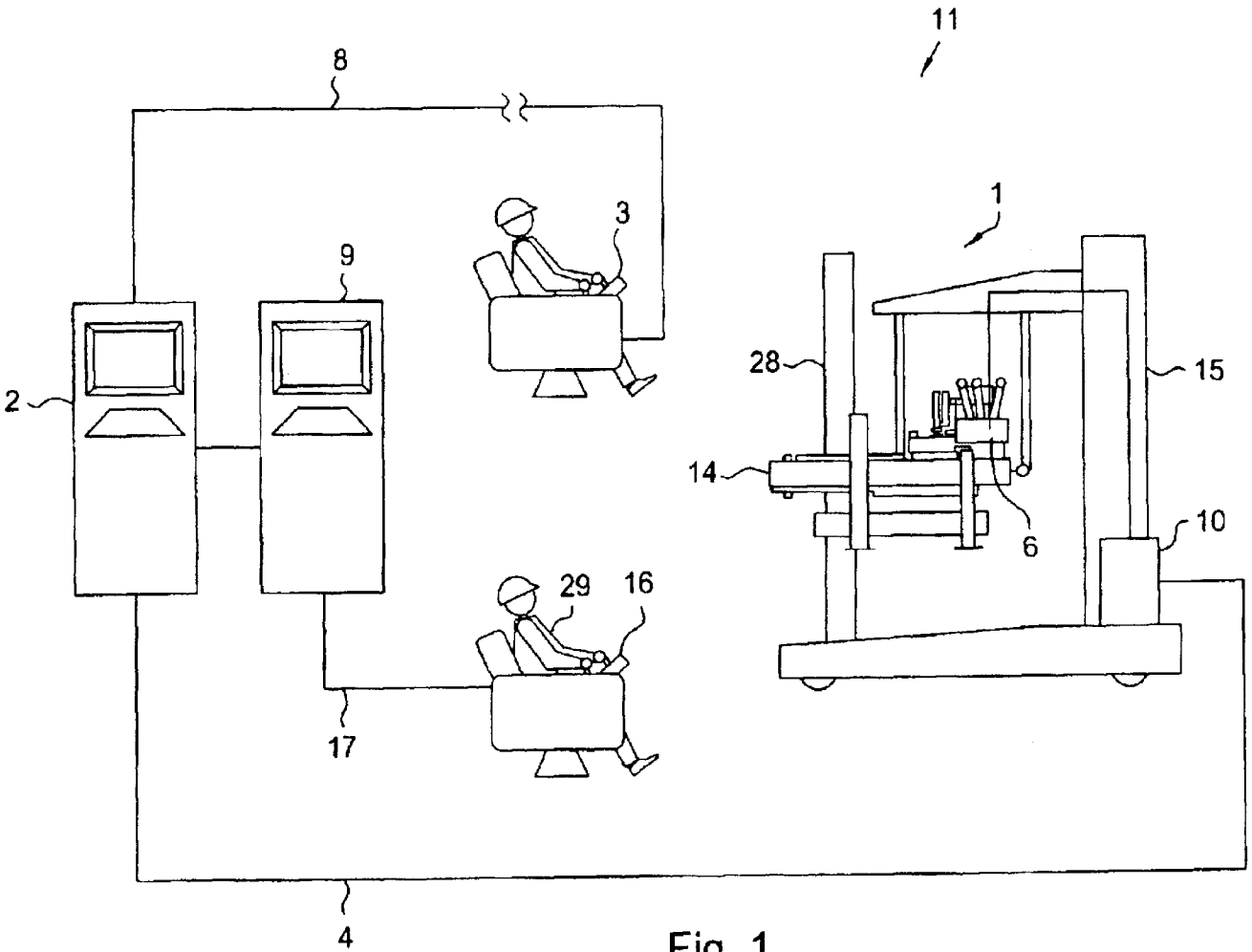
FIG. 1 is a view of a rig control and monitoring system.

In the present invention FIG. 1 is a view of one embodiment of a rig control and monitoring system 11 according to the invention. The rig control and monitoring system 11 includes a piece of well bore equipment 1, which in turn includes a rig control system 15, which may include a Power Frame™ available from Weatherford International of Houston, Tex., or a Torq Winder™, also available from Weatherford International. Such a system 15 is typically used for operating a tong 14 which holds a tube or casing 28. One sensor module 6 is assigned to this system 15. The sensor module 6 may be, for example, a JAM (joint analyzed makeup) monitoring means, also available from Weatherford International. Such a JAM monitoring means is used to monitor torque, turns and rotations per minute of the tong to ensure that all tubing and casing connections confirm to a manufacturer's specification. The corresponding parameters monitored by the sensor module are typically torque and turns. The data corresponding to the measured parameter is submitted by the sensor module to an individual control means 10 assigned to the corresponding well bore equipment 1.

It is also possible that the corresponding data is directly submitted by communication link 4 to a universal data acquisition and control system 2.

The communication link 4 may be a wire transmission link or a field bus link. Examples for such a field bus are Profibus, Interbus, CANBus, LightBus or even other communication links as RS232 or RS485 or others.

In FIG. 1, there is only one piece of well bore equipment and one sensor module 6 assigned thereto. However, it is possible to provide multiple sensor modules 6 assigned to a single piece of well bore equipment 1 or to transmit data from multiple sensor modules 6 at different locations and assigned also to different pieces of well bore equipment 1.

One universal data acquisition and control system 2 suitable for use in this invention is a HiPer™ control system available from Weatherford, which is an operating platform suitable for all mechanized rig systems in which the corresponding components can be operated remotely by utilizing this system.

From the universal data acquisition and control system 2 the collected data is transmitted by communication link 8 to personnel or an operator working at a distance from sensor module 6. For example, the operator may be located onshore when the well site is offshore.

The communication link 8 is realized by a bus transmission such as Ethernet. The connection over Ethernet is in general a TCP/IP connection.

The operator uses a remote control/monitoring unit 3 which may be, for example, a laptop computer. This laptop serves as a display unit and may also serve as an evaluation unit for the data received from the universal data acquisition and control system 2.

Other possibilities for the communication link 4 are wireless transmissions, for example, radio transmission via satellite, or a fiber optic transmission.

The communication links 4, 8 are fully duplex, and it is also possible to retransmit control data from the remote control/monitoring unit 3 to the universal data acquisition and control system 2. These control data may then be used by the universal data acquisition and control system 2 to modify or adjust well bore equipment 1 such that the parameter measured by sensor module 6 is within predefined limits or such control data may be used to stop the operation of the corresponding well bore equipment 1.

Another universal data acquisition and control system 9 may be connected to system 2 through a communication link 17, and may also be used to remotely control the well bore equipment 1 from another computer or laptop 16 wherein the corresponding operator is arranged offshore, i.e. on rig site. This operator directly controls the well bore equipment 1 and may also receive the control data from the remote control/monitoring unit 3 for adjusting his operation in response to the received control data.

In the particular case of a JAM monitoring system as a sensor module, a load cell for torque measuring and a turn counter may transmit data to the universal data acquisition and control system as a generalized measuring device. The corresponding control data received by the universal data acquisition and control system 2 may be transmitted to a corresponding valve control block assigned to the corresponding well bore equipment 1 is operated via system 2 for control of tong speed and torque.

It is also possible that sensor modules measure other parameters as for example temperature, pressure, flow etc. Moreover, the sensor module may also detect a leak or the like.

Figure 2:
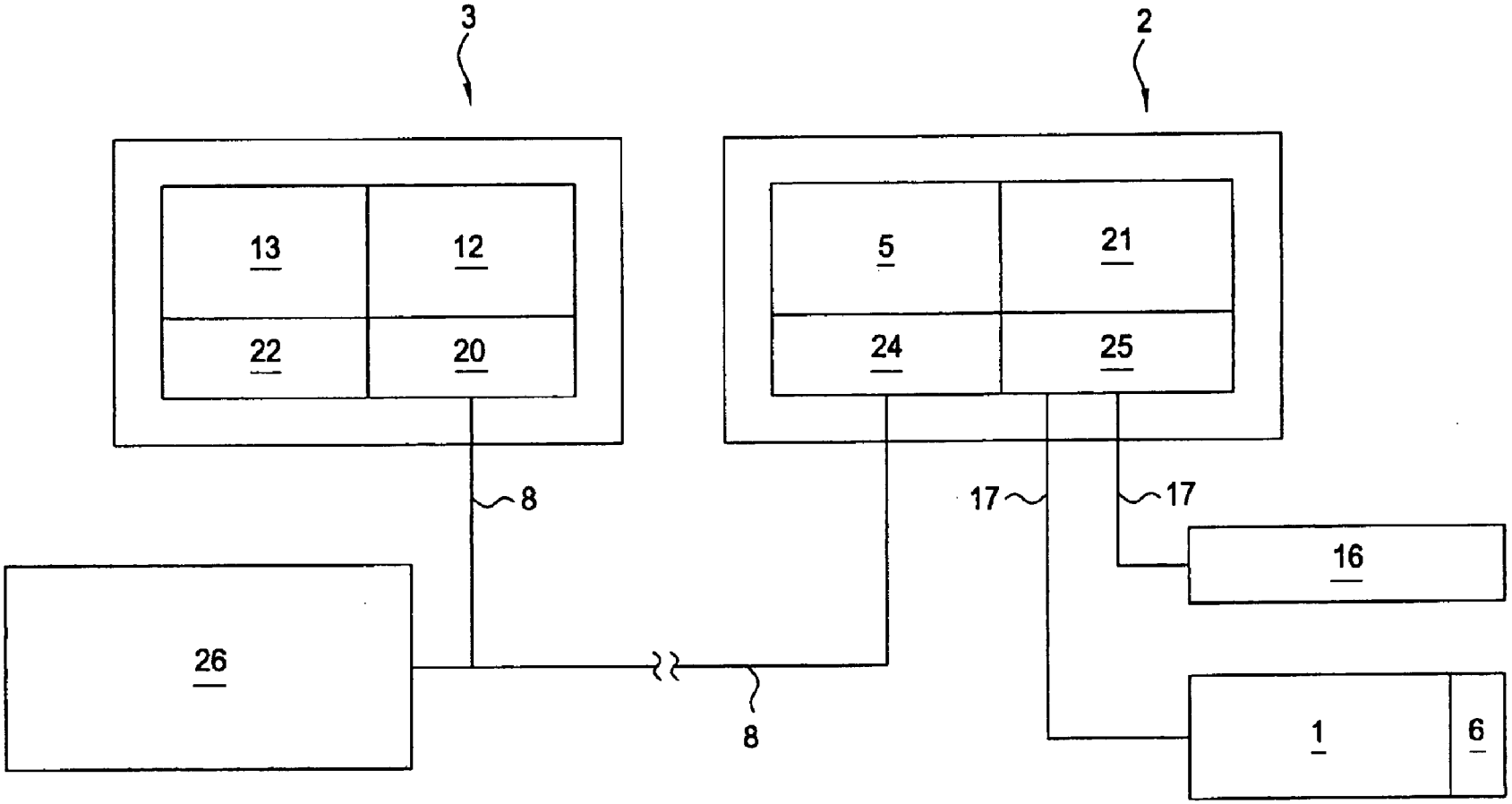
FIG. 2 is a view of a communication structure with corresponding communication links used according to FIG. 1.

FIG. 2 is a more detailed view of the communication structure used by the rig control and monitoring system 11 according to FIG. 1.

The universal data acquisition and control system 2 comprises for example a memory storage means 5 which may be used for immediate storage of data collected from one or more sensor modules 6. Of course, this memory storage means 5 may also be used for storing other data of the well bore equipment 1 or for storing control data received from the remote control/monitoring unit 3.

The universal data acquisition and control system 2 further comprises a programmable logic control device 21 and interfaces 24 and 25 for the corresponding communication links to the remote control/monitoring unit 3 and the sensor module 6 or well bore equipment 1 and further remote control means 16, see the operator 29 in FIG. 1 with laptop 16. The communication link between laptop 16 of operator 29 or sensor module 6/well bore equipment 1 and universal data acquisition and control system 2 is realized by a field bus 17 which may be a Profibus, Interbus, RS232, RS485 or others.

The other interface 24 is used for realizing the communication link to the remote control/monitoring unit 3 by Ethernet 8. As already said, it is also possible that this communication is a radio transmission via satellite, a fiber optic transmission, etc.

The remote control/monitoring unit 3 also comprises another interface 20 and further a display means 12 and a storage means 13. The display means 12 is used for visualizing the evaluated data received from the universal data acquisition and control system 2 as a graph, a table, etc. For evaluating the corresponding data, a corresponding evaluation module 22 is stored in the remote control/monitoring unit, wherein, the evaluation module 22 may be provided on any kind of at least readable storage means.

In FIG. 2, there is not only an Ethernet communication link between universal data acquisition and control system 2 and the remote control/monitoring unit 3, but also between control system 2 and at least one further supervising means 26. This may be arranged at a different location and may be used for remote debugging, supervising, collecting data for maintenance, etc.

The corresponding or general communication link 8, such as Ethernet, between remote control/monitoring unit 3 and universal data acquisition and control system is also used for forwarding an interpretation of the data to the corresponding rig control system 15 or well bore equipment 1 such that it can be immediately decided if the parameters are in predefined limits.

In another example, the applied torque and rotation in making up a shouldered tubular connection are measured at regular intervals throughout a pipe connection makeup. The rate of change of torque with rotation (derivative) is calculated for each set of measurements. These three values (torque, rotation and rate of change of torque) are then compared either continuously or at selected rotational positions, with minimum and maximum acceptable predetermined values, and a decision made whether to continue rotation or abort the makeup. Additionally, the derivative (rate of change of torque) is compared with predetermined threshold values to determine seal and shoulder contact points. The change in torque and rotation between these two detected contact points is checked to ensure that the change is within a predetermined acceptable range. When the shoulder contact is detected, a predetermined torque value and/or rotation value is added to the measured torque and/or rotation values, respectively, at shoulder contact and rotation continued until this calculated value(s) is reached. The application of torque is terminated and the reverse rotation of a tubing length is monitored as the connection relaxes. If the relaxation is within an acceptable predetermined range and the above conditions are met then the makeup is considered acceptable.

According to the invention, it is in particular possible to remove personnel from the well bore or well center area on the rig without interruption of the operation of the well bore equipment due to safety reasons as there may be an intermediate response back from the remote control/monitoring unit 3 to the universal data acquisition and control system 2 and further to the corresponding well bore equipment 1 or rig control system 15. Consequently, there is not only real time data acquisition and evaluation according to the method of the invention but also real time operation of the corresponding well bore equipment or rig control system to react on the evaluation of the collected data.

In addition to the display capabilities set forth above, information can be displayed in other useful ways, especially information related to operating variables of automated equipment on a rig floor. For example, utilizing the hardware and software described herein, it is possible to display items in a three dimensional format whereby variables like torque, turns, and time are independently illustrated along with their relationship to each other. Using this three dimensional format, it is also possible to dissect the image to give a snap shot of any one or two of the variables at any particular time. In this manner, the make up of a joint, for instance can be analysed at any time.

One obvious advantage of a having a three dimensional graph instead of three, independent graphs (Torque—Turn, Torque—time and RPM-turns) is that an operator has only to observe one graph instead of three. It is also possible to color code the graph to further simply the illustration and make it even easier to distinguishing between variables in the 3D image. Additionally, the coloring can be programmed whereby in the event of an error or bad condition, a portion of the graph representing the variable with the problem can become red in color, alerting an operator's attention to the condition. Additionally, with the design of the 3D graph display, the graph may be rotated in a way that brings one of the parameters into the foreground for more specific observation. In addition, when using a graph as the foregoing, energy (or pre-load) which is imparted into the connection may be calculated out of the volume under the graph, which could be another parameter for the evaluation of a connection.

Because of the plurality of sensor modules, the universal data acquisition and control system, additional control system, control/monitoring units, it is of advantage when all these devices are synchronized.

Furthermore, to provide the universal data acquisition and control system with more flexibility such that it may be used for different equipments at different locations or also for different equipment at the same location, it may comprise a programmable logic control means.

While the foregoing is directed to embodiments of the present invention, other and further embodiments of the invention may be devised without departing from the basic scope thereof, and the scope thereof is determined by the claims that follow.

What is claimed is:

1. A method for remotely controlling and/or monitoring at least one parameter of well operation equipment at an oil or gas well, comprising:

i) collecting data corresponding to the at least one parameter by a sensor module assigned to the well operation equipment and adapted to collect data referring to at least torque and number of rotations for monitoring joint make-up of tubing and casing connections;

ii) transmitting the collected data to an on-site universal data acquisition and control system, the universal data acquisition and control system located proximate the well;

iii) transmitting said collected data from the universal data acquisition and control system to a remote control/monitoring unit via a communication link;

iv) displaying and/or analyzing the collected data, and v) transmitting control data from the control/monitoring unit back to at least the universal data acquisition and control system for modifying the operation of the well operation equipment within predefined limits.

2. The method of claim 1, wherein the well operation equipment is oil field tubular handling equipment.

3. The method according to claim 1, further comprising storing the collected data is stored in a memory storage means of the universal data acquisition and control system.

4. The method according to claim 1, wherein the data from the sensor module is transmitted to the universal data acquisition and control system via a wireless transmission.

5. The method according to claim 1, wherein the data is transmitted from the sensor module to the universal data acquisition and control system via wire transmission.

6. The method according to claim 1, wherein the data is transmitted from the universal data acquisition and control system to the control/monitoring unit via bus transmission means with corresponding interfaces.

7. The method according to claim 1, wherein the data is transmitted from the universal data acquisition and control system to the control/monitoring unit via a fiber optic transmission means.

8. The method according to claim 1, wherein the data is transmitted from the universal data acquisition and control system to the control/monitoring unit via a wireless transmission means.

9. The method according to claim 1, wherein the data is transmitted from sensor modules at multiple locations to the universal data acquisition and control system.

10. The method according to claim 9, wherein the data is stored from all sensor modules to provide a complete make-up history of all mechanized well operation equipment.

11. The method according to claim 1, wherein the data is displayed and/or stored from a plurality of sensor modules by the control/monitoring unit.

12. The method according to claim 1, wherein the universal data acquisition and control system provides on-site access to the collected data or the received control data.

13. The method according to claim 1, wherein the control data is transmitted to a separate control system different from the universal data acquisition and control system.

14. A rig control and monitoring system comprising:

i) at least one piece of mechanized well bore equipment with a sensor module assigned thereto;

ii) an on-site universal data acquisition and control system; and, iii) a remote control/monitoring unit comprising a torque—turn and torque—time monitoring means and connected with said universal data acquisition and control system by a first communication link, wherein the control/monitoring unit includes a display means and/or a storage means and said universal data and control system is connected with the sensor module for data transmission by a second communication link.

15. The rig control and monitoring system according to claim 14, wherein said mechanized well bore equipment is one of a group consisting of: tubing or casing tongs, drill pipe tongs, remote operated tongs, tong position systems, make-up and break out tools, systems for automatic tubular handling and running, connection leak detecting systems, slips, spiders, pressure control equipment, and packers.

16. The rig control and monitoring system according to claim 14, wherein said sensor module is one of a group consisting of: torque sensor module, turn counter sensor module, pressure sensor module, temperature sensor module and flow sensor module.

17. The rig control and monitoring system according to claim 14, wherein the universal data acquisition and control system is an operating platform for remotely operating the mechanical well bore equipment or the rig control system.

18. The rig control and monitoring system according to claim 14, wherein the universal data acquisition and control system is arranged on an offshore rig.

19. The rig control and monitoring system according to claim 14, wherein the remote control/monitoring unit is a computer.

20. The rig control and monitoring system according to claim 19, wherein the control/monitoring unit comprises at least one evaluation module to evaluate the received data and to display same as a graph, table, or bar.

21. The rig control and monitoring system according to claim 14, wherein sensor modules from multiple locations are connected to the universal data acquisition and control system.

22. The rig control and monitoring system according to claim 14, wherein at least one of the communication links is a high data rate communication link.

23. The rig control and monitoring system according to claim 14, wherein at least one of the communication links is one of a group consisting of: radio transmission link, fiber optic communication link, and bus link.

24. The rig control and monitoring system according to claim 14, wherein the first communication link is a bus link and the bus link is one of a group consisting of: ethernet, field bus, RS232, and RS485.

25. The rig control and monitoring system according to claim 14, wherein the second communication link is a control data transmission link for transmitting adjustment data.

26. The rig control and monitoring system according to claim 14, wherein the communication links are fully duplexed.

27. The rig control and monitoring system according to claim 14, wherein the universal data acquisition and control system comprises a programmable logic control device.

28. The rig control and monitoring system according to claim 14, wherein the first communication link is a connection over ethernet and the ethernet connection is a TCP/IP connection.

29. A rig control and monitoring system comprising:

i) at least one Piece of mechanized well bore equipment with a sensor module assigned thereto;

ii) an on-site universal data acquisition and control system; and, iii) a remote control/monitoring unit and connected with said universal data acquisition and control system by a communication link, wherein the control/monitoring unit includes a display means and/or a storage means, said universal data and control system is connected with the sensor module for data transmission, and at least one other control/monitoring unit can be connected to the universal data acquisition and control system as a back up unit.

30. A method of monitoring and/or adjusting parameters of a tubular make up at a well site, comprising:

i) collecting data related to a connection, the data including torque, turn, and time parameters; and ii) displaying the parameters graphically using a software that permits the parameters to be analyzed at any time during the make up.

31. The method of claim 30, wherein the parameters can be displayed in a 3 dimensional format and the display can be manipulated to show one or any pair of the parameters.

* * * * *